US011077348B1

(12) United States Patent
Stokke

(10) Patent No.: US 11,077,348 B1
(45) Date of Patent: Aug. 3, 2021

(54) GOLF SWING TRAINING AID

(71) Applicant: Kevin Byron Stokke, Zimmerman, MN (US)

(72) Inventor: Kevin Byron Stokke, Zimmerman, MN (US)

( * ) Notice: Subject to any disclaimer, the term of this patent is extended or adjusted under 35 U.S.C. 154(b) by 0 days.

(21) Appl. No.: 16/872,093

(22) Filed: May 11, 2020

(51) Int. Cl.
*A63B 69/36* (2006.01)
*A63B 69/00* (2006.01)
*A63B 102/32* (2015.01)

(52) U.S. Cl.
CPC ..... *A63B 69/0059* (2013.01); *A63B 2102/32* (2015.10); *A63B 2209/08* (2013.01); *A63B 2209/10* (2013.01)

(58) Field of Classification Search
CPC ..... A63B 69/0059; A63B 2102/32; A63B 2209/10; A63B 2209/08
USPC .... 473/62, 63, 207, 212, 214, 447, 448, 450
See application file for complete search history.

(56) References Cited

U.S. PATENT DOCUMENTS 3,339,926 A * 9/1967 Coupar ..... A63B 69/0059 473/214
3,970,305 A * 7/1976 Hawkins ..... A63B 71/14 473/62
4,372,298 A * 2/1983 Lerman ..... A61F 5/0123 602/26
4,605,227 A * 8/1986 Hurd ..... A63B 69/0046 403/104
5,222,733 A * 6/1993 Brunty ..... A61F 5/0123 473/214
7,658,681 B1 * 2/2010 Malecha ..... A63B 69/3608 473/214
7,775,898 B1 * 8/2010 Allen ..... A63B 69/0059 473/214
9,095,758 B2 * 8/2015 Shew ..... A63B 69/3608
2010/0317449 A1 * 12/2010 Proplesch ..... A63B 69/3608 473/214
2017/0182392 A1 * 6/2017 Middleton ..... A63B 69/0046

* cited by examiner

*Primary Examiner* — Nini F Legesse
(74) *Attorney, Agent, or Firm* — Michael A. Mochinski

(57) ABSTRACT

A golf swing training aid to assistively train a golfer the proper position and motion of the golfer's leading and trailing arms during certain phases of a golf swing, which primarily includes a strap assembly for releasably securing the training aid to the golfer's leading arm and an upper arm cradle connecting to a lower arm cradle by a hinging assembly with each of the arm cradles including an upper member integrally connecting and curvilinearly transitioning to a pair of longitudinal sidewalls. A locking assembly configured with first and second housing sections respectively attached to the upper and lower arm cradles houses a moveable shaft that fulfills to lock the arm cradles in a collinear arrangement and unlock the arm cradles to further pivotal movement relative to one another about the hinging assembly, particularly as such to correspond with the bending movement of the leading arm during the follow-through phase of the golf swing.

30 Claims, 13 Drawing Sheets

GOLF SWING TRAINING AID

FIELD OF THE INVENTION

The present invention is generally directed to a golf swing training aid that fulfills to assistively train a golfer in establishing the proper position and motion of the golfer's arms during a golf swing. More particularly, the golf swing training aid attaches to the golfer's leading arm to promote a degree of relaxed linearity thereto at address and during the backswing and downswing motions of the golf swing so that one may appreciably feel the correct plane and path on which a golf club travels, consequently enhancing one's opportunity of making solid and precise contact with a golf ball.

BACKGROUND OF THE INVENTION

Golf is a popular pastime in many parts of the world and is conceptually understood by those that actively participate in the game: swing a golf club at a golf ball and attain the fewest strokes as possible for each hole on the golf course. Although fairly easy to understand, implementation of swing concepts to attain a lower score is more perplexing to those activity involved in the game of golf and strive to get better, whether they are categorically a beginner, an amateur or an elite professional. Regardless of one's skill set or abilities, a common denominator among those that participate in the game is to possess a golf swing that enables one to consistently strike the golf ball with controlled accuracy and equally with appreciable distance. A golfer's ability to improve to attain a lower score during a golf round generally correlates to the golfer's ability to adhere to proper swing mechanics in view of recognized fundamentals, such as grip, posture, alignment, balance, and so forth, all of which have direct bearing on the swing plane and path the golf club travels during the backswing and downswing motions, including through the golf ball impact zone and follow through until the finish. Instructional materials and instructors in general take the view that certain swing mechanics in the nature of a straightened, but relaxed leading arm at setup while addressing the golf ball and maintaining it during the backswing and downswing motions can advantageously set the golf club on a proper plane and travel onto a path that fulfils to strike the golf ball with explosive force for longer distances. Conversely, a bent leading arm can cause a myriad of problems during the golf swing that may necessitate compensatory movement or correction so that one may hopefully fulfill contact with the golf ball and directionally advance it forward down and along a golf hole's fairway, generally with an uncontrollable flight pattern and perhaps with unpredictable results.

Since the game's inception centuries ago, the golf swing has been greatly studied and analyzed with all intents of helping the golfer improve. Over the years and to this day, an assortment of instructional material appearing in books, journals, articles, and videos offer much insight into the means of acquiring the perfect golf swing so that one may hopefully attain a lower golf score. Further, golfers may seek the attention of a qualified instructor or professional that can equally offer hands-on instruction in relation to the fundamentals and teach the requisite, sequential movements of an effective golf swing. Regardless of the source of instruction, aspiring golfers desiring improvement may employ the use of training devices or aids to appreciably gain the proper feel of certain aspects of the motion involved in a golf swing in view of one's comprehension of instructional methodologies or teachings offered by the instructor or other sources.

In recognition of the golfer's desire to improve, the prior art offers a variety of mechanical devices, aids and mechanisms directed to assisting the golfer with the mechanics of the golf swing in view of adhering to accepted and recognized golf fundamentals. For example, U.S. Pat. No. 5,445,385 issued to Brooks discloses a golf training device that minimizes bending of the golfer's leading arm during a golf swing, which comprises in part a laminated body composed of multiple layers that permits cylindrical formation and conforming fit around the golfer's leading arm, with the device being generally held in place by a strap and buckle assembly. Although possibly effective for its intended purpose, such to offer a degree of rigidity to the leading arm, it may unduly restrict and hinder the golfer's ability to moderately bend the leading arm after making impact with the golf ball so as to retain the proper plane on which the golf club travels during the follow through and consequently allow the golf ball to travel relatively down or at least along the intended target line.

In yet another golf training device, U.S. Pat. No. 7,658,681 issued to Malecha discloses a golf swing aid apparatus for holding a leading arm in a relatively straightened position while executing a golf swing, which comprises in part first and second plates each having concavely arcuate configurations and connecting to one another by a hinging assembly, whereby a predetermined amount of force exerted on the hinging assembly allows the first and second plates to move away from a collinear relationship and pivot relatively about the hinging assembly. Like Brooks, Malecha offers straps circumferentially positioned around the leading arm as means for securing the golf swing aid apparatus to the golfer's arm. Though the apparatus in Malecha is perceived to allow bending of the leading arm after impact with the golf ball, any amount of exerted force onto the hinging assembly, perhaps unintentionally during the backswing and downswing motions of the golf swing, may inadvertently allow the plates to lose their collinear relationship and defeat the intended purpose of retaining a relatively straightened leading arm in certain critical moments of the golf swing.

Accordingly, there remains a need for a simple, yet cost effective golf swing training aid that meaningfully addresses many of the common faults and issues associated with the training aids and devices heretofore known in the art, particularly a training aid that assists the golfer in developing a proper swing pattern, teaches the golfer proper positioning and feel of his/her arms during a golf swing that through repeated use thereof establishes long-term retention, and allows the golf club to travel on a correct plane and path that yields a widened swing arc for maximum amount of applied hitting force to the golf ball that consequently produces a longer distance in relation to its flight.

BRIEF SUMMARY OF THE INVENTION

In order to overcome the numerous drawbacks apparent in the prior art, a golf training aid has been devised for a golfer that desires to feel the proper arm position and motion throughout the golf swing and through repeated use thereof during moments of practice, establishes an increased opportunity for a repeatable and predictable swing pattern in absence of its use during regular golf play.

It is an object of the present invention to provide a golf training aid that limits the extent by which the golfer's leading arm bends throughout the golf swing, particularly as such to avoid an overlong backswing that detrimentally causes an additional hinge point in the golf swing and consequently adverse compensatory movement during the golf swing.

It is a further object of the present invention to provide a golf training aid that fulfills to establish a moderate amount of relaxed linearity to a golfer's leading arm while at address and during the backswing and downswing phases of the golf swing so as to maintain a widened swing arc for increased opportunity for solid and precise contact with a golf ball and in turn, observable improvements in relation to distance in golf ball flight, shot consistency, and reliability.

It is yet another object of the present invention to provide a golf training aid that is relatively simple in terms of design and construction and readily attaches to a golfer's leading arm, particularly being advantageously useful during periods of practice play.

It is yet another object of the present invention to provide a golf training aid that allows a golfer's leading arm to properly fold on the follow through after impact with the golf ball such to allow the golf club to continue on the correct plane and the golf ball on the intended target line.

It is yet another object of the present invention to provide a golf training aid that fulfills to correct tempo issues associated with the takeaway phase of the golf swing that may otherwise lead to occurrences of extraneous compensatory movements in relation to other phases of the golf swing.

It is a further object of the present invention to provide a golf training aid that mitigates unwanted bending of the golfer's leading arm during the backswing motion, consequently facilitating proper rotation of the hips, torso and shoulders.

It is a further object of the present invention to provide a golf training aid that minimizes over flexion of the trailing arm as a consequence of a relatively straightened leading arm at the transitional phase of the golf swing so as to establish the proper arm structure by which the golf club can travel on plane during the downswing phase of the golf swing for increased opportunity of delivering the golf club with power and exerting an explosive force to the golf ball.

In accordance with the present invention a golf swing training aid has been devised for assistively training a golfer develop the proper arm motion and form throughout the golf swing and through repeated use thereof during practice, establishes an increased opportunity for a repeatable and predictable swing pattern in absence of its use during regular golf play, the golf swing training aid principally comprising a strap assembly having proximal and distal straps for circumferentially engaging the golfer's leading arm and an upper arm cradle connecting to a lower arm cradle by a hinging assembly and momentarily in certain aspects of operation by a locking assembly, the upper and lower arms cradles each having an upper member integrally connecting and curvilinearly transitioning to a pair of longitudinal sidewalls, a bridging member integrally connecting to and extending outwardly from each of the upper members, and a pair of opposing protuberances integrally connecting to the bridging member for supporting connection of the distal straps, the locking assembly being configured with first and second housing sections respectively attached to the upper and lower arm cradles houses therewithin a moveable shaft that fulfills to lock the upper and lower arm cradles in a collinear arrangement so as to effect a relative amount of relaxed linearity to the golfers' leading arm during the backswing and downswing phases of the golf swing and unlock the upper and lower arm cradles to further pivotal movement relative to one another about the hinging assembly so as to correspond with the bending movement of the golfer's leading arm that generally occurs during the follow-through phase of the golf swing.

Other objects, features, and advantages of the present invention will become apparent in the following detailed description of the preferred embodiments thereof when read in conjunction with the accompanying drawings in which like reference numerals depict the same parts in the various views.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE INVENTION

While this invention is susceptible of being embodied in many different forms, the preferred embodiment of the invention is illustrated in the accompanying drawings and described in detail hereinafter with the understanding that the present disclosure purposefully exemplifies the principles of the present invention and is not intended to unduly limit the invention to the embodiments illustrated and presented herein. The present invention has particular utility as a golf swing training aid that assists the golfer in developing a proper swing pattern, teaches the golfer proper positioning and feel of his/her arms during a golf swing that through repeated use thereof establishes long-term retention, and allows the golf club to travel on a correct plane and path to the extent of establishing a widened swing arc for maximum amount of applied hitting force to a golf ball.

Figure 1:
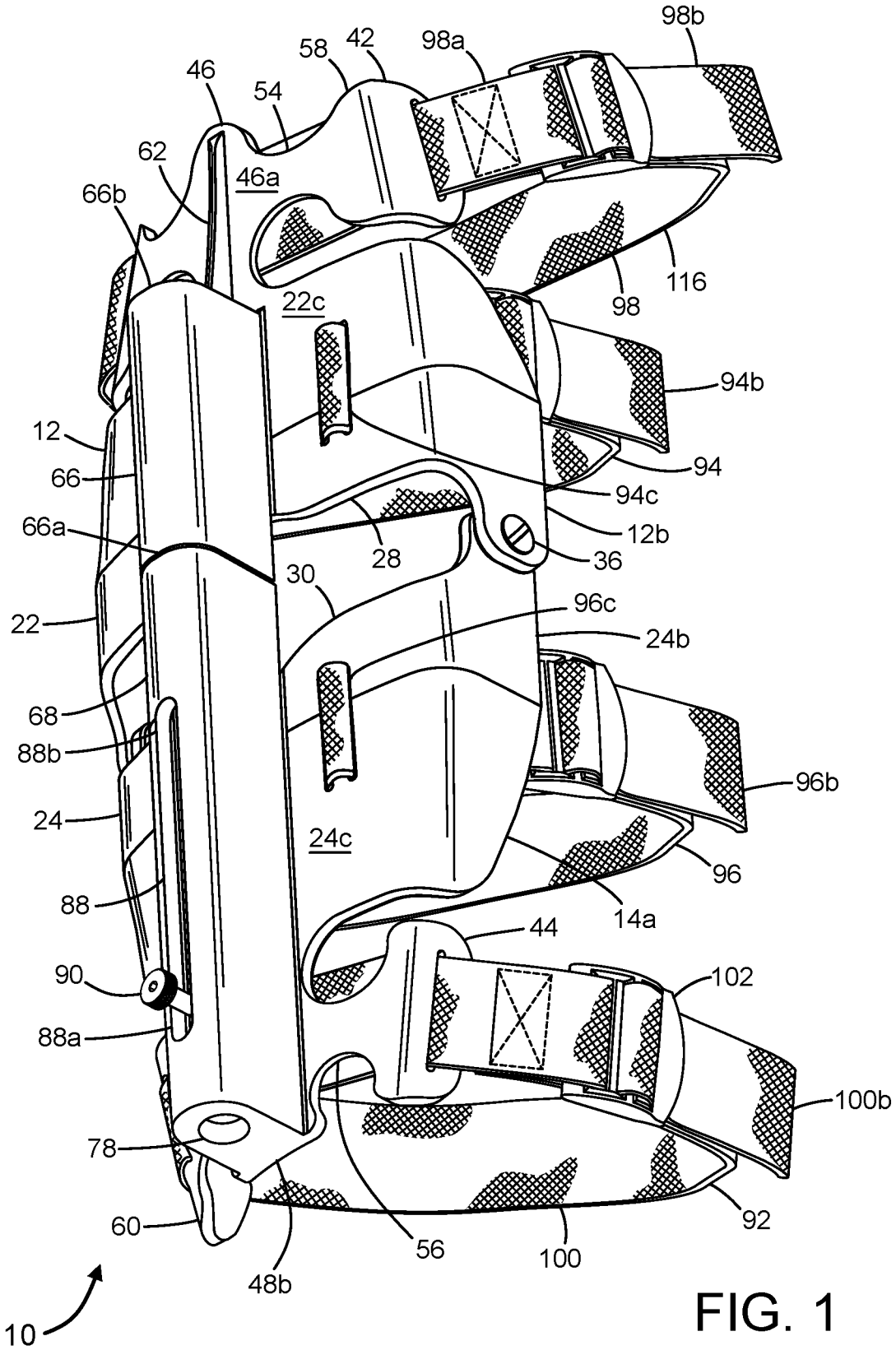
FIG. 1 is a top perspective view of the preferred embodiment of the present invention illustrating a strap assembly, an upper arm cradle pivotally connecting to a lower arm cradle by a hinging assembly, and first and second housing sections respectively mounted atop the upper and lower arm cradles.
Figure 2:
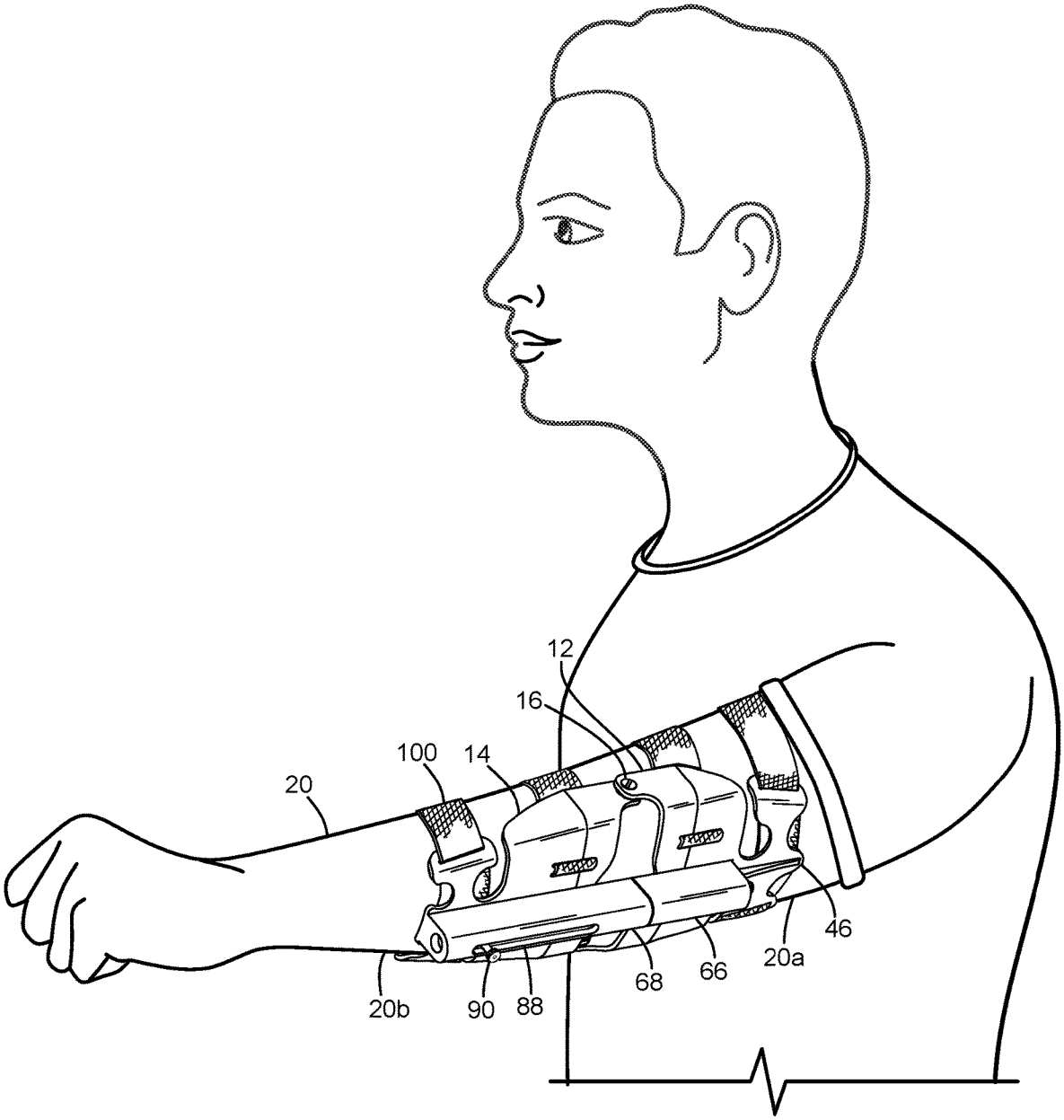
FIG. 2 is a top perspective view of the preferred embodiment of the present invention illustrating an upper arm cradle pivotally connecting to a lower arm cradle by a hinging assembly and a locking assembly lockingly engaging the upper and lower arm cradles in a collinear arrangement as relatively worn on a golfer's leading arm.

Referring now to FIG. 1, there is shown generally at 10 a golf swing training aid comprising an upper arm cradle 12 connecting to a lower arm cradle 14 by a hinging assembly 16 and momentarily in certain aspects of operation by a locking assembly 18, whereby the upper and lower arm cradles are preferentially configured for fitment respectively above and below an elbow joint of a golfer's leading arm 20. It is understood within the context of this disclosure that the leading arm of a right-handed golfer refers to the left arm, whereas the leading arm of a left-handed golfer refers to the right arm. FIG. 2 illustrates attachment of the golf swing training aid to the leading arm of the right-handed golfer, for example.

Figure 3:
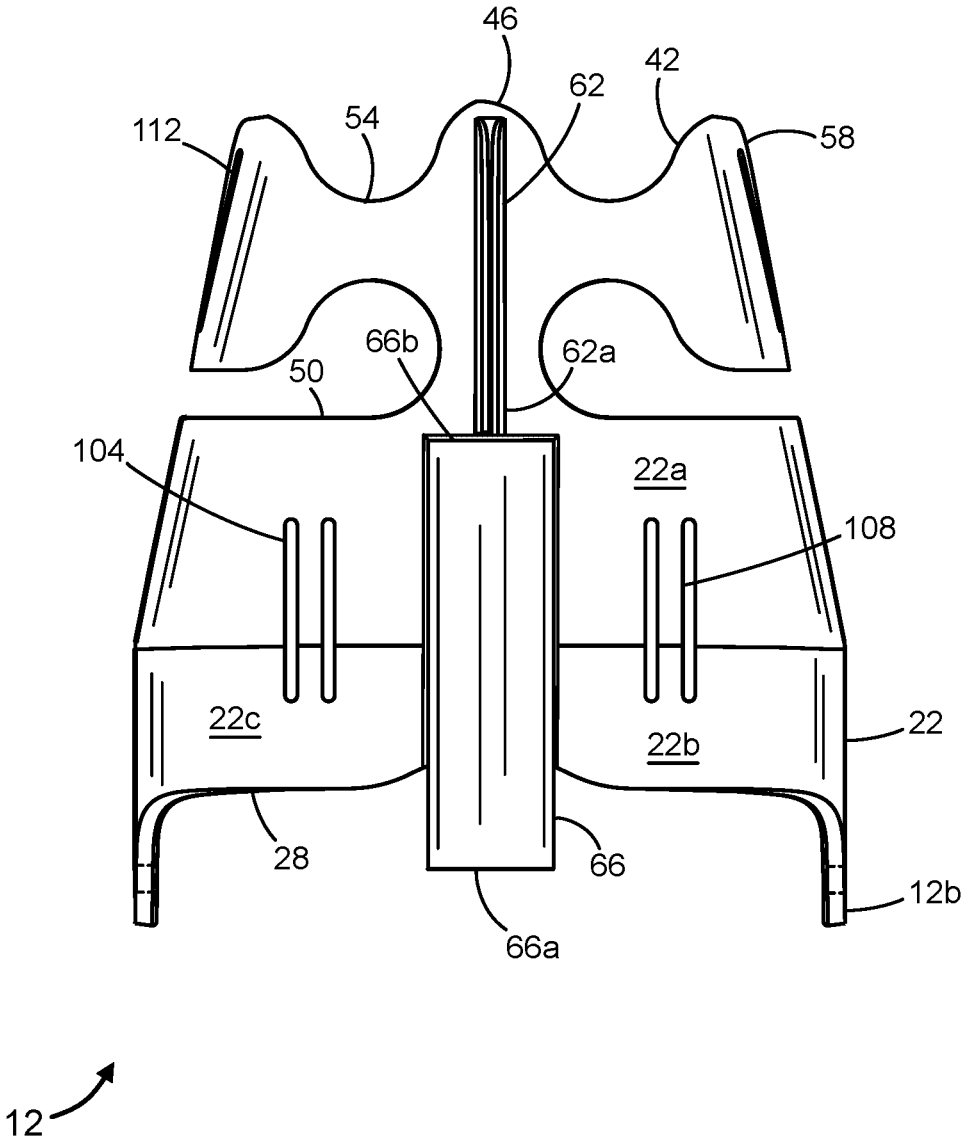
FIG. 3 is a top plan view of the preferred embodiment of the present invention illustrating an upper arm cradle having a first housing section mounted atop an upper member, a bridging member integrally connecting to the upper member and a pair of opposing protuberances, and a pair of dual elongate apertures passing through the upper member.
Figure 4:
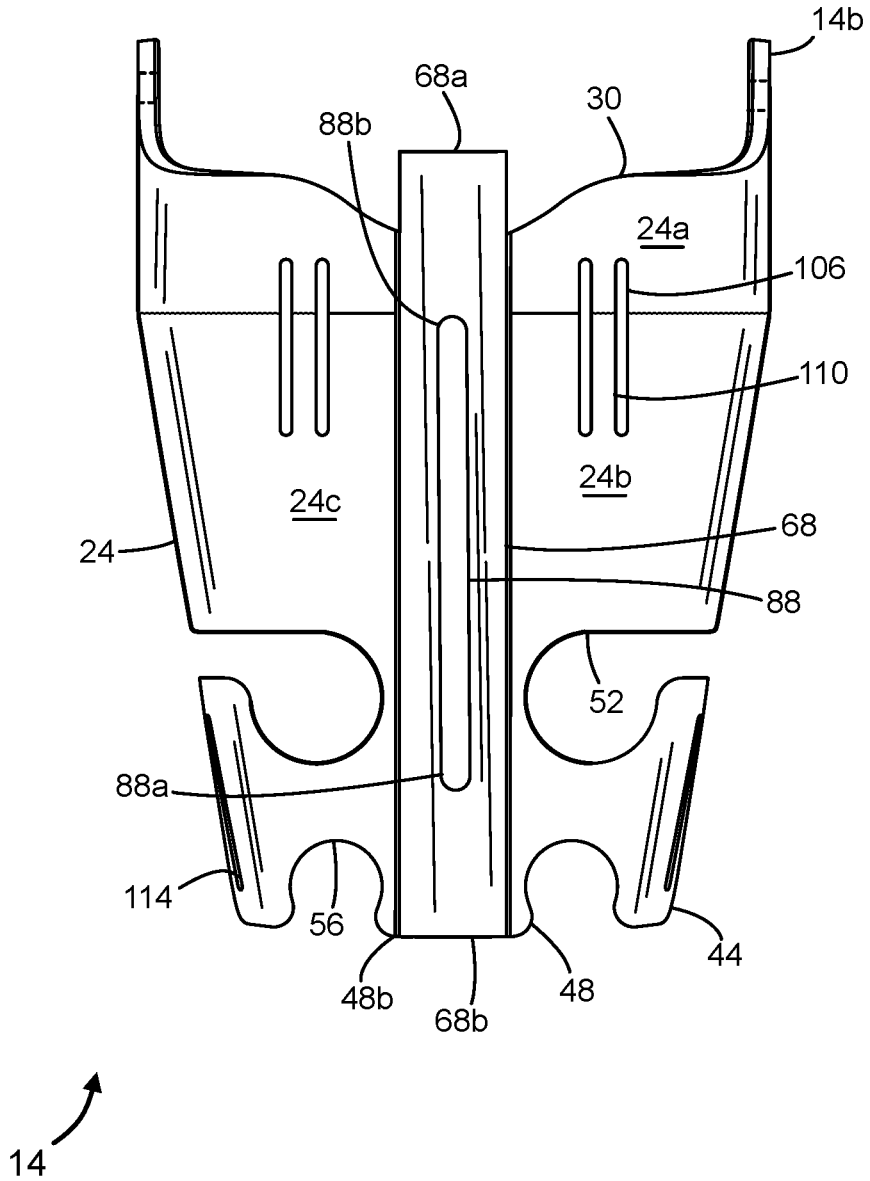
FIG. 4 is a top plan view of the preferred embodiment of the present invention illustrating a lower arm cradle having a second housing section mounted atop an upper member, a bridging member integrally connecting to the upper member and a pair of opposing protuberances, and a pair of dual elongate apertures passing through the upper member.
Figure 5:
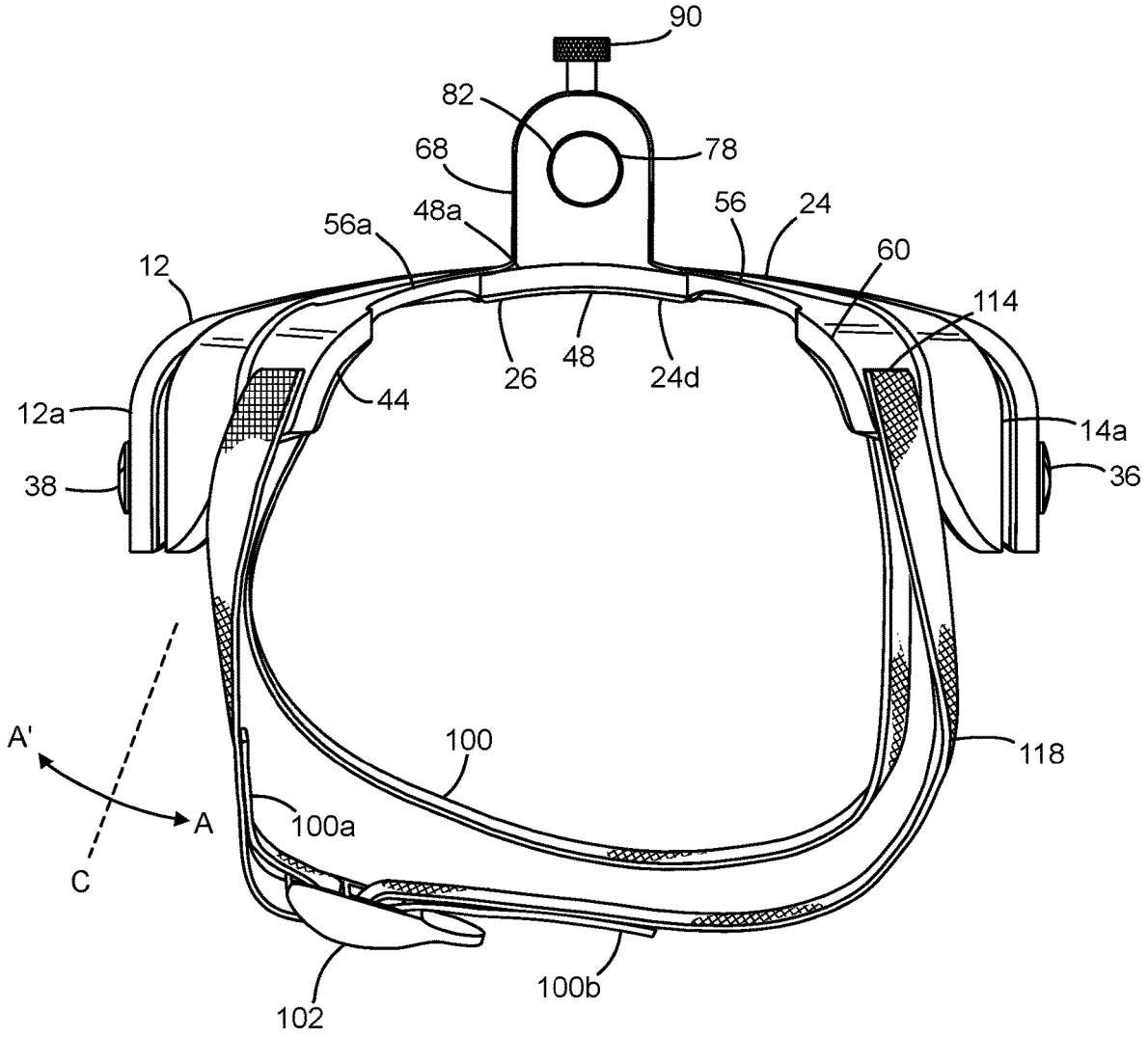
FIG. 5 is an end view of the preferred embodiment of the present invention illustrating upper and lower arm cradles positioned in a collinear manner to form an arm conforming channel and each having an upper member transitioning to a pair of longitudinal sidewalls and a bridging member extending outwardly from the upper member and integrally connecting to a pair of opposing protuberances with each having a spanning element connecting to a curvilinear portion configured with an elongate aperture for supporting a distal strap.

As principally shown in FIGS. 3 and 4, the upper and lower arm cradles each comprises an upper member 22, 24 being distinctly defined in form by a widened portion 22*a*, 24*a* transitioning to a tapered portion 22*b*, 24*b* and integrally connecting and curvilinearly transitioning to a pair of longitudinal sidewalls 12*a*, 14*a*. Accordingly, upon observation of an end view of the golf swing training aid 10 as depicted in FIG. 5, the upper and lower arm cradles 12, 14 collectively positioned in a collinear manner will generally form an arm-conforming channel 26 particularly being suited to geometrically accommodate and engage in part the triceps 20*a* and forearm area 20*b* of the golfer's leading arm 20, with the hinging assembly 16 generally being in proximity to the golfer's elbow joint to permit angular positioning of the upper and lower arm cradles relative to one another and correlate with the moderate bending of the golfer's leading arm that generally occurs during the follow-through phase of the golf swing.

Integrally connecting to and extending linearly outward from each of the longitudinal sidewalls 12*a*, 14*a* of the upper and lower arm cradles is a flange 12*b*, 14*b* configured with an aperture that furthers unrestricted operation or freedom of movement of the hinging assembly 16 during use and operation of the golf swing training aid 10. A first end 28 of the upper arm cradle as specifically shown in FIG. 6 comprises a wider width than that of a first end 30 of the lower arm cradle so as to allow their respective flanges to slidably engage and mate with one another and further effect alignment of the apertures extending through the flanges 12*b*, 14*b* to form first and second sets of aligned apertures 32, 34. A pass-through bolt assembly 36, 38 placed within and extending through each set of aligned apertures provided by the mating arrangement of the flanges of the upper and lower arm cradles 12, 14 constitutes the structure by which the hinging assembly 16 allows unhindered pivotal movement of the upper and lower arm cradles relatively about the pass-through bolt assembly 36, 38 and consequently angular positioning of the lower arm cradle 14 relative to the upper arm cradle 12 as it travels along path A in FIG. 7, such as during the follow-through phase of the golf swing. In some instances of application, it may be desirable to place in between the mating flanges a washer 40 that suffices as a spacing element to promote a minute amount of separation thereof for minimizing effects of binding and further the ease by which the hinging assembly can pivotally operate.

Figure 8:
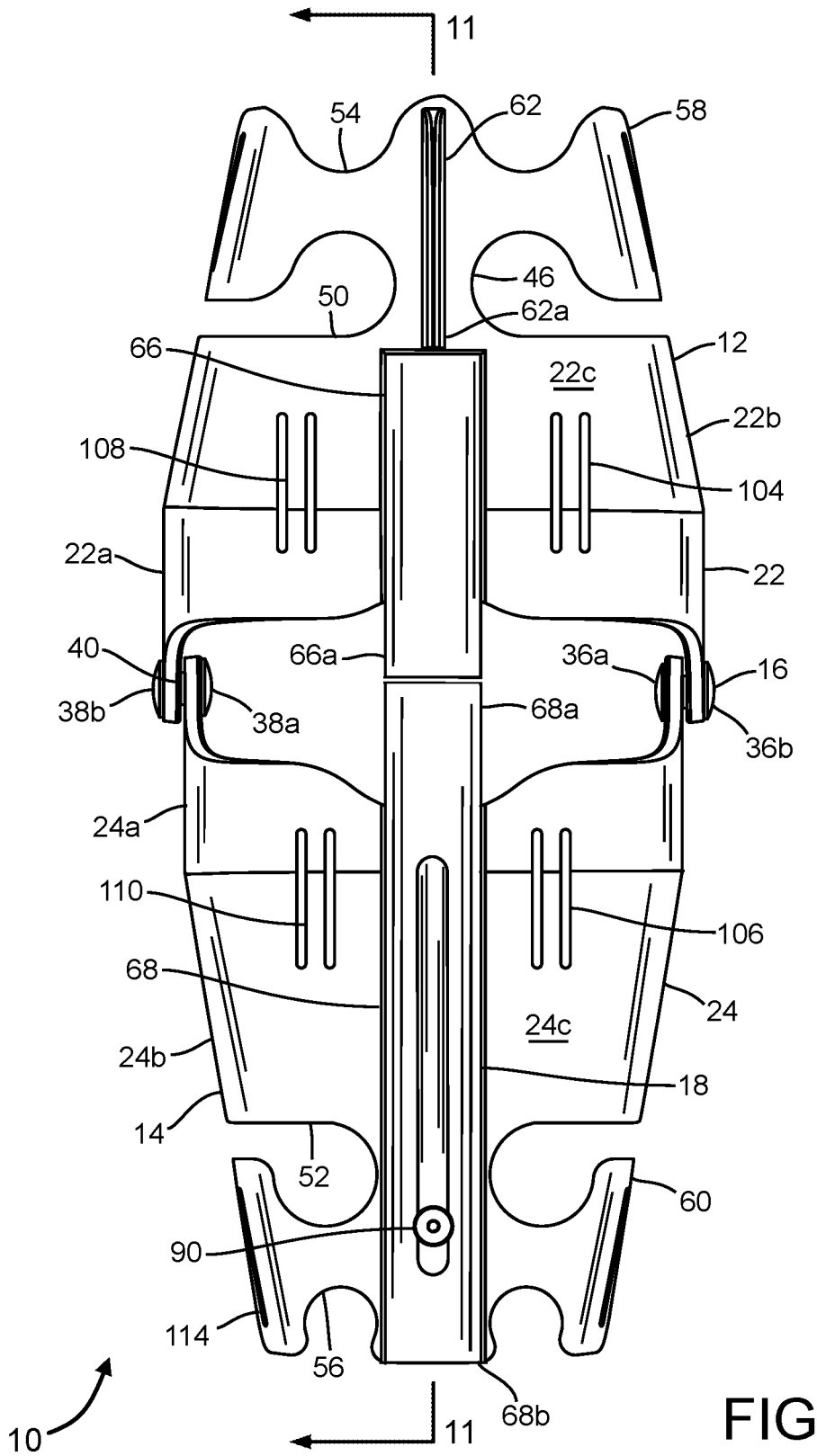
FIG. 8 is a top plan view of the preferred embodiment of the present invention illustrating an upper arm cradle pivotally connecting to a lower arm cradle by a hinging assembly and first and second housing sections respectively mounted atop upper members of the upper and lower arm cradles with the second housing section having an elongate opening.
Figure 9:
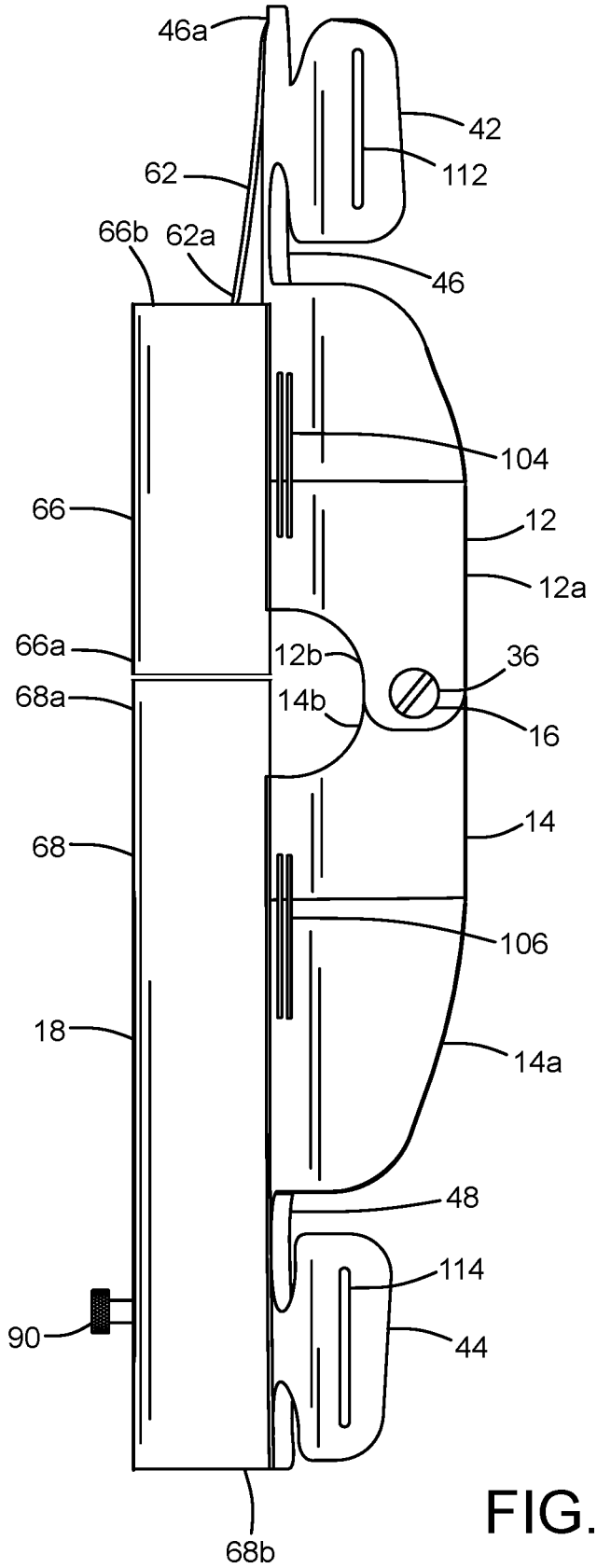
FIG. 9 is a side elevational view of the preferred embodiment of the present invention illustrating an upper arm cradle pivotally connecting to a lower arm cradle by a hinging assembly and first and second housing sections respectively mounted atop of the upper and lower arm cradles.

In further association with each of the upper and lower arm cradles is a pair of opposing protuberances 42, 44 that integrally connect to and extend outwardly from a bridging member 46, 48 emanating from and connecting to their respective upper members 22, 24. Each bridging member is shown in FIGS. 8 and 9 as having a top side 46*a*, 48*a* existing coplanar with a top surface 22*c*, 24*c* of the upper member 22, 24 and extending beyond second ends 50, 52 of the upper and lower arm cradles, whereby each opposing protuberance is primarily formed by a spanning element 54, 56 extending outwardly from the bridging member and integrally connecting to a curvilinear portion 58, 60 that generally coincides in form with the longitudinal sidewalls 12*a*, 14*a* of the upper and lower arm cradles. The spanning element, as particularly shown in FIG. 5, is formed with a wall 54*a*, 56*a* having a predetermined thickness marginally less than that of the bridging member's thickness by at least one-third to one-half, thus inherently contributing to the spanning element's capability to flex and radially move relative to the neighboring structures of the upper member and bridging member in situations of applied force to the curvilinear portion 58, 60, as may generally occur in the direction of A and A' relative to its static position at centerline C in FIG. 5. In further observation of the bridging member 46 of the upper arm cradle 12, a reinforcing rib 62 of the type shown in FIGS. 1 and 9 extends along the length of the bridging member and offers to supplement the structural strength of the bridging member under force loads that may be exerted on the associated pair of opposing protuberances 42 during operable conditions.

Figure 10:
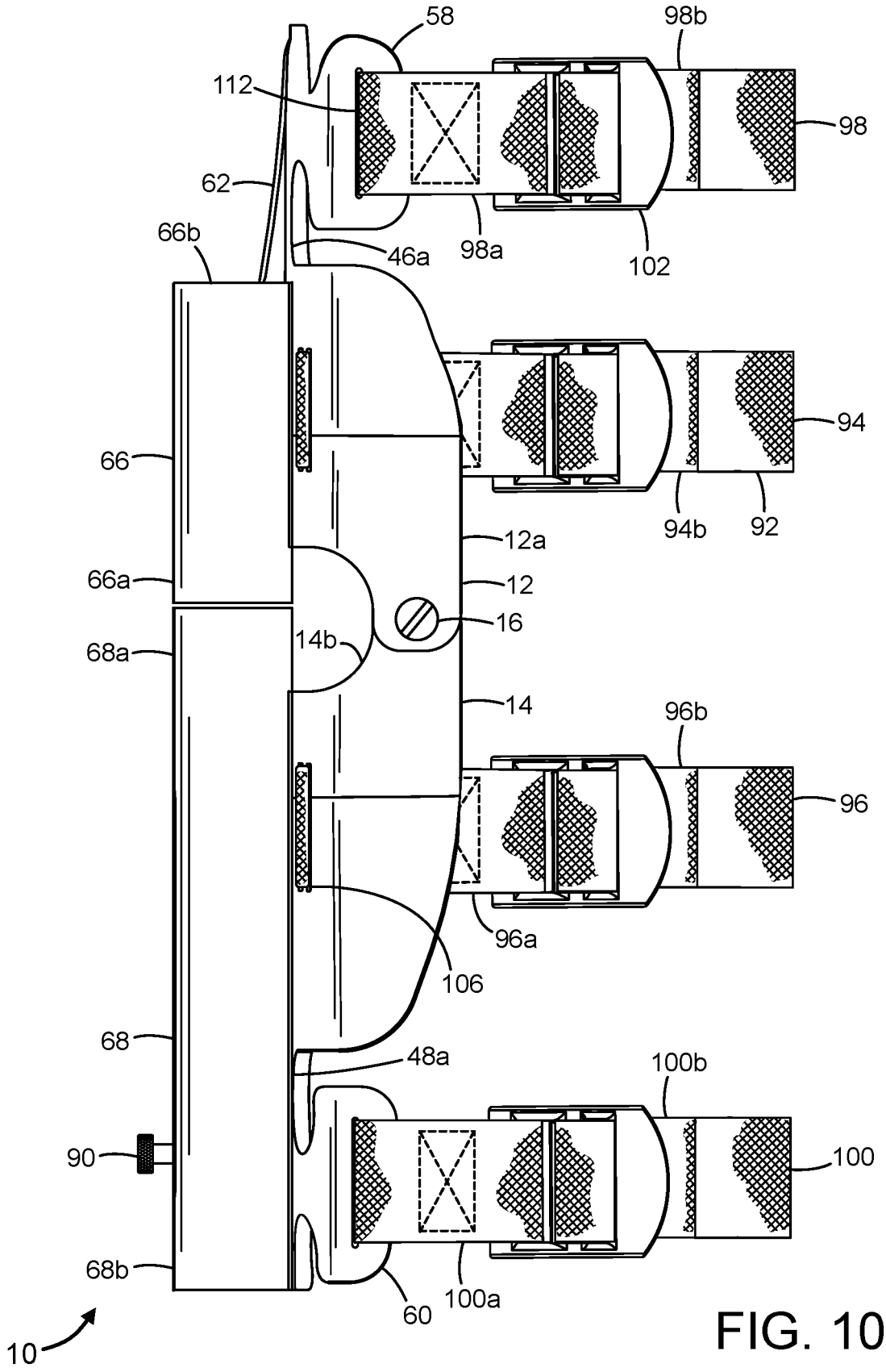
FIG. 10 is a side elevational view of the preferred embodiment of the present invention illustrating upper and lower arm cradles configured with a strap assembly comprising proximal and distal straps respectively passing through dual elongate apertures and elongate apertures with each of the straps having first and second ends connected by a buckle.

The locking assembly 18 as generally illustrated in FIGS. 8 and 9 comprises in part first and second housing sections 66, 68 integrally connecting to and extending upwardly from the top surfaces 22*c*, 24*c* of the upper members 22, 24 of the upper and lower arm cradles, respectively. The first housing section 66 is shown in FIG. 8 as having a proximal end 66*a* existing beyond and overhanging the first end 28 of the upper arm cradle 12 in proximity of the mating flanges 12*b*, 14*b* of the hinging assembly 16, whereas a distal end 66*b* thereof extends relatively in vicinity of the respective bridging member's connective relationship to the upper member 22 such to abut with an end 62*a* of the reinforcing rib 62. Comparatively, the second housing section 68 is shown in FIGS. 8 and 10 as having a proximal end 68*a* similarly existing beyond and overhanging the first end of the lower arm cradle 14 in proximity of the mating flanges of the hinging assembly 16, whereas a distal end 68*b* thereof generally exists atop the respective bridging member 48 and extends to an outward end 48*b* of the bridging member.

Figure 11:
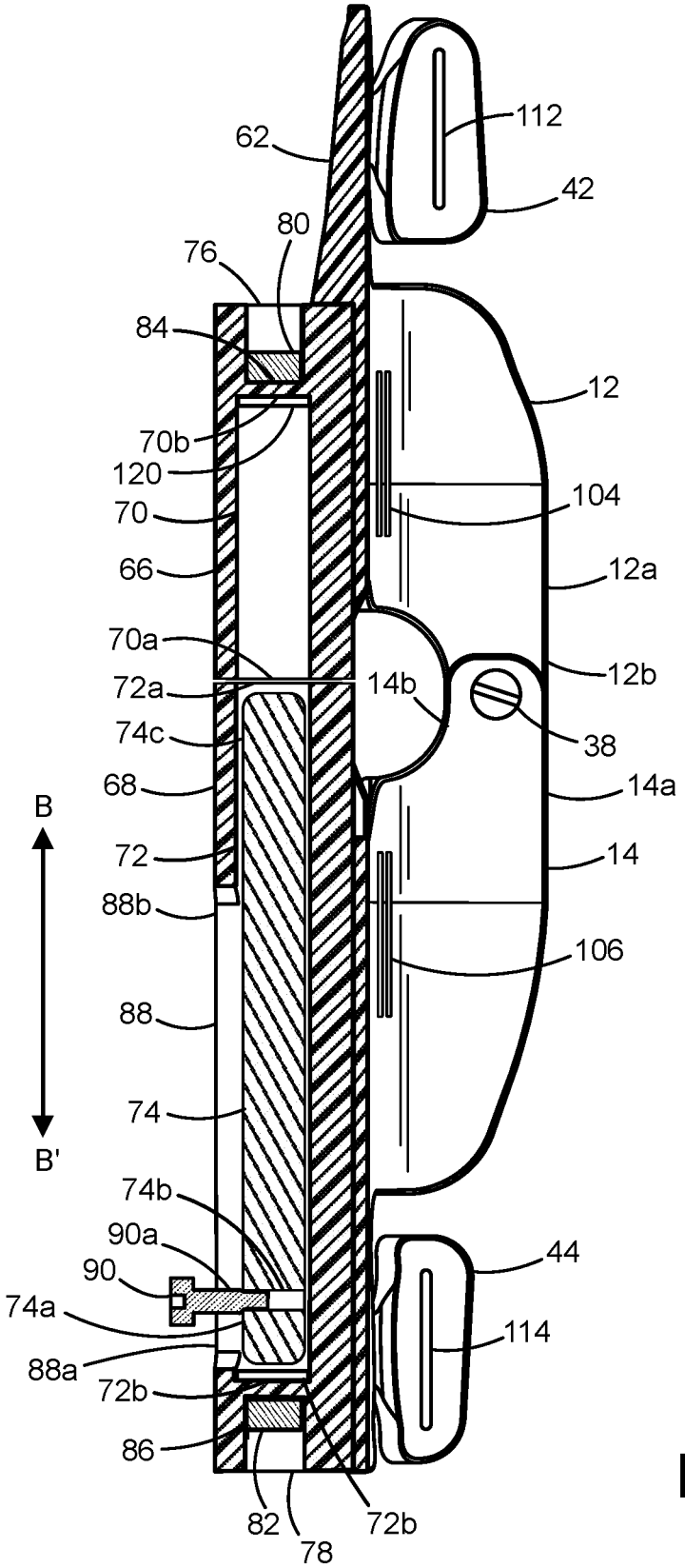
FIG. 11 is a cross sectional view of the preferred embodiment of the present invention taken along lines 11-11 in FIG. 8 illustrating upper and lower arm cradles each respectively having first and second housing sections mounted thereto for housing a moveable shaft configured with a handle and a first open cavity integral to the first housing section and second open cavity integral to the second housing section with each of the open cavities respectively accommodating first and second magnets.

Each of the first and second housing sections is further associated with an internal bore 70, 72 of cylindrical form or equivalent geometric structure extending about their respective lengths to transitorily accommodate and pass therewithin a movable shaft 74 having an equivalent geometric configuration in relation thereto. The internal bore as associated with each of the first and second housing sections 66, 68 is depicted in FIG. 11 as having an open end 70*a*, 72*a* at their respective proximal ends and a closed internal end 70*b*, 72*b* in vicinity of their respective distal ends. In further respects, the distal ends 66*b*, 68*b* of the first and second housing sections respectively accommodate first and second open cavities 76, 78 for housing therein first and second magnets 80, 82. In the preferred embodiment, each magnet of circular-plate form is generally press-fitted within the open cavity such to abut against an internal wall 84, 86 shared with the closed internal end 70*b*, 72*b* and may be glued in place for long-term retention within the open cavity.

Figure 6:
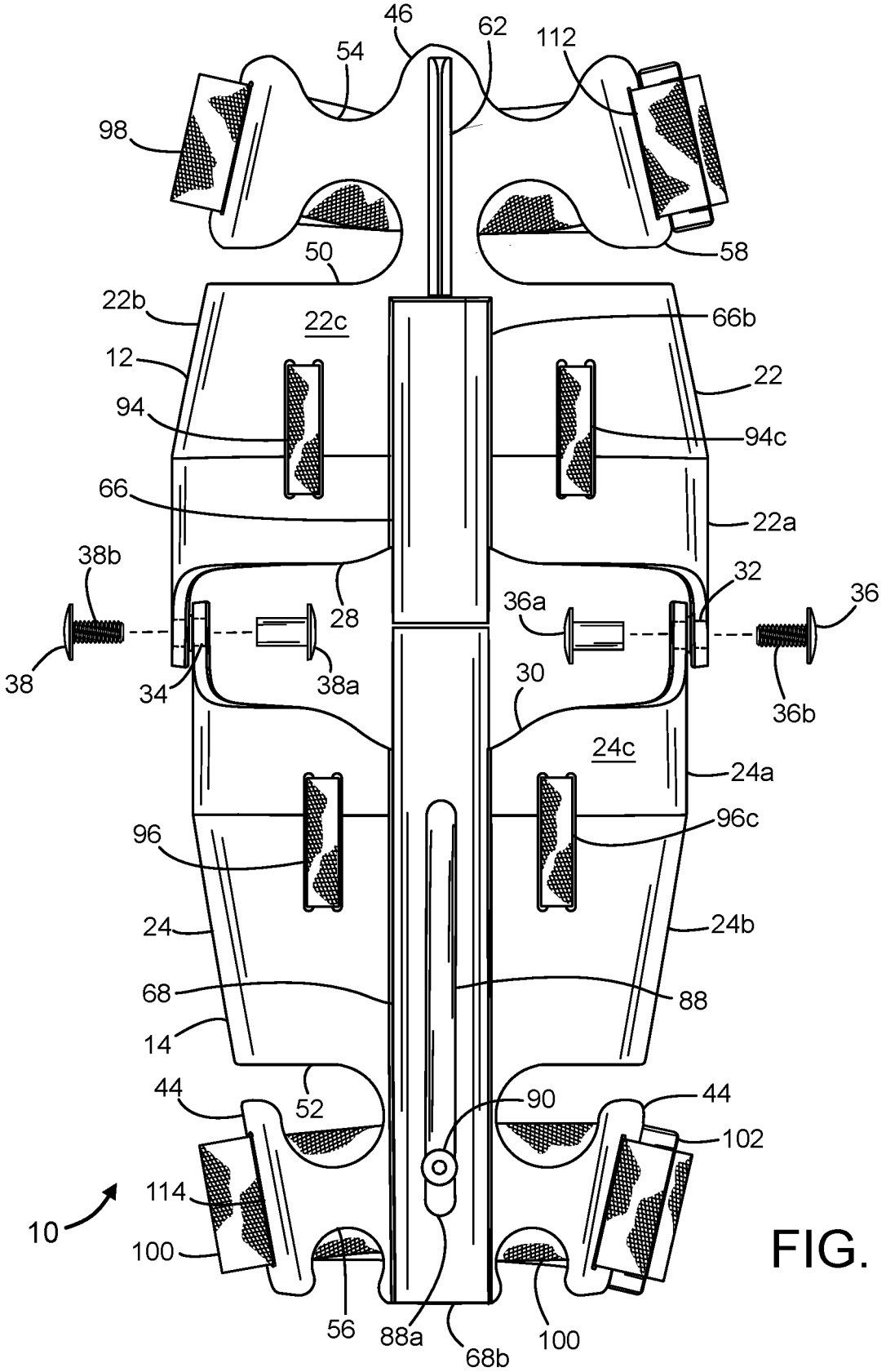
FIG. 6 is a top plan view of the preferred embodiment of the present invention illustrating flanges of an upper arm cradle slidably mating with flanges of a lower arm cradle, first and second sets of aligned apertures each being held together by a pass-through bolt assembly, and proximal and distal straps respectively positioned through pairs of dual elongate apertures present in upper members of the upper and lower arm cradles and pairs of elongate apertures present in curvilinear portions of the opposing protuberances.
Figure 7:
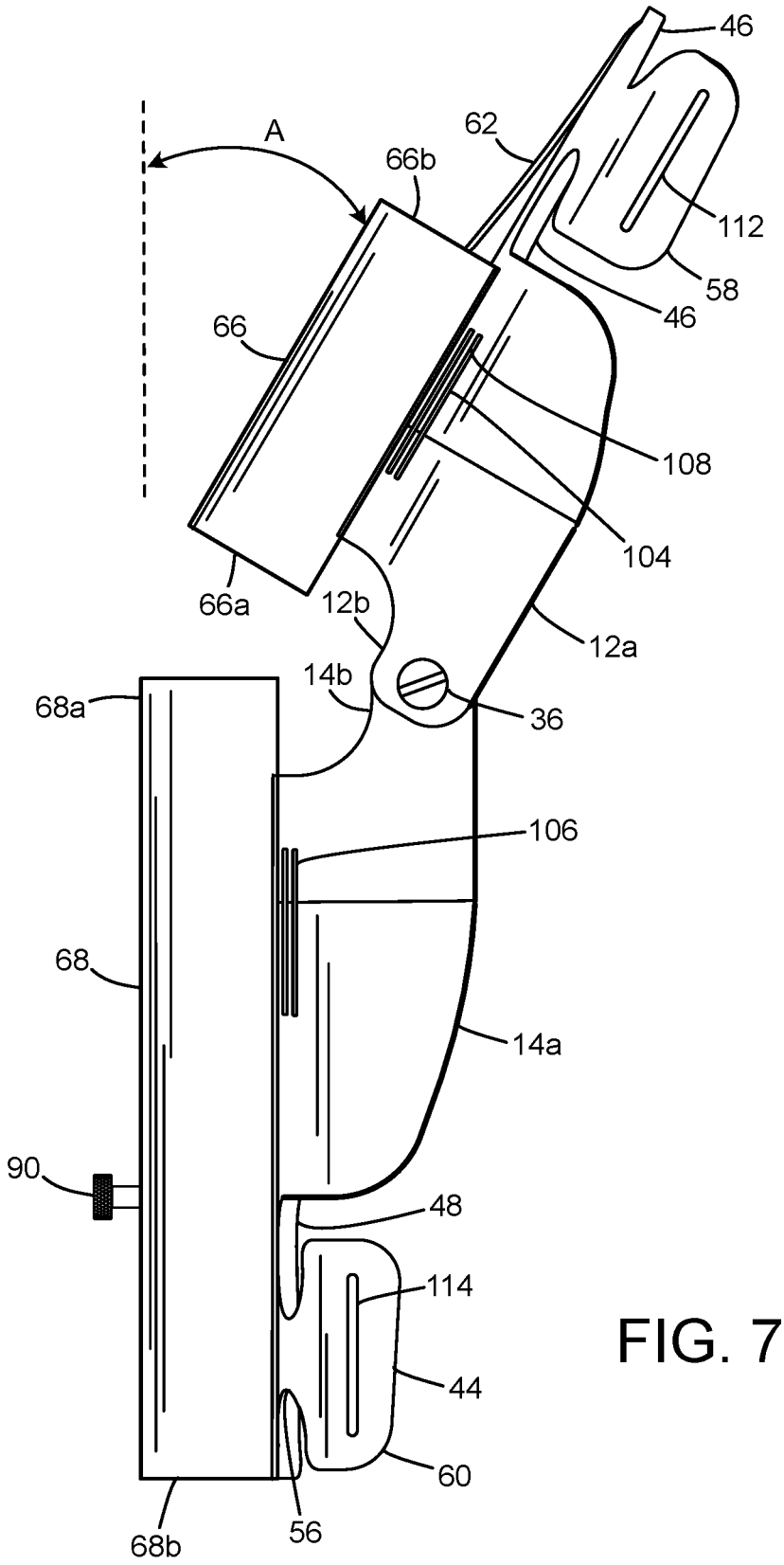
FIG. 7 is a side elevational view of the preferred embodiment of the present invention illustrating an upper arm cradle pivotally connecting to a lower arm cradle by a hinging assembly with the upper arm cradle being angularly displaced from the lower arm cradle along path A.

In reference to FIGS. 6 and 11, the second housing section 68 of the lower arm cradle 14 is further associated with an elongate opening 88 in open communication with its internal bore 72 to accommodate passage of an upright handle 90 generally connecting in vicinity of a first end 74*a* of the moveable shaft 74. The upright handle in this regard is a screw having a threaded end 90*a* that threadably engages a threaded bore 74*b* extending perpendicularly into the moveable shaft. The elongate opening as generally illustrated in FIG. 4 extends from approximate the widened portion 24*a* of the upper member 24 of the lower arm cradle 14 and terminates in vicinity of its respective bridging member 48.

As particularly described in FIG. 11, the effective length of the moveable shaft 74 is one that allows it to retract and reside entirely within the geometric confines of the internal bore 72 of the second housing section 68 with the upright handle 90 generally being positioned in vicinity of a distal end 88*a* of the elongate opening 88, thus establishing the structure by which the locking assembly 18 attains a disengaged state. Retention of the moveable shaft for continued disengagement is effectively maintained through the magnetic interaction of the first end 74*a* of the moveable shaft with the second magnet 82 of the lower arm cradle 14. Consequently, by means of this structural relationship and magnetic interaction, the lower arm cradle 14 can freely pivot about the hinging assembly and angularly rotate relatively in reference to the upper arm cradle 12 without undue structural hinderance from the moveable shaft, particularly being operably advantageous for the follow-through phase of the golf swing.

Comparatively, as the moveable shaft 74 slidably relocates within the coaxial alignment of the internal bores 72, 74 of the first and second housing sections 66, 68 and advances until a second end 74*c* of the moveable shaft abuts against the closed internal end 70*b* of the first housing section 66, a predetermined amount of the moveable shaft's length will reside simultaneously within each of the internal bores 70, 72 of the first and second housing sections with the handle 90 generally being positioned in vicinity of a proximal end 88*b* of the elongate opening 88, thus establishing the structure by which the locking assembly attains an engaged, locking state. Retention of the moveable shaft 74 for continued, locking engagement is effectively maintained through the magnetic interaction of the second end 74*c* of the moveable shaft with the first magnet 80 of the upper arm cradle 12. Consequently, by means of this structural relationship and magnetic interaction, the upper and lower arm cradles are capable of maintaining their collinear relationship, particularly being operably advantageous for the setup, backswing and downswing phases of the golf swing.

Figure 12:
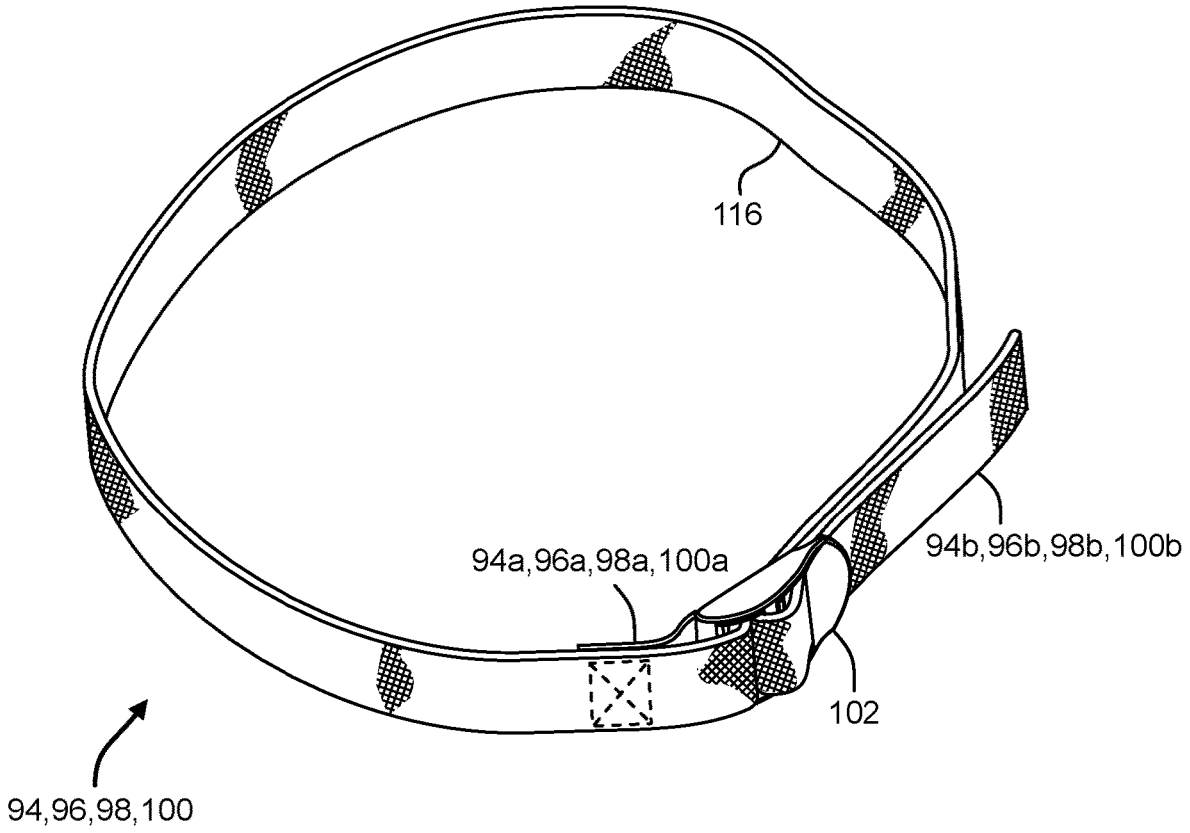
FIG. 12 is a top perspective view of the preferred embodiment of the present invention illustrating typical configuration of a proximal strap or distal strap with each having a first end connecting to a second end by a buckle.

Referring now to FIGS. 1, 2 and 10, attachment of the golf swing training aid 10 to the golfer's leading arm 20 is fulfilled by a strap assembly 92 comprising proximal straps 94, 96 and distal straps 98, 100 designated as a paired set for each of the upper and lower arm cradles 12, 14. Each strap is configured with a first end 94*a*, 96*a*, 98*a*, 100*a* and a second end 94*b*, 96*b*, 98*b*, 100*b* that are conventionally held together or engaged with one another by connective means, preferably a buckle 102 of the type generally depicted in FIG. 12. It is contemplated within the scope of this disclosure that connective means may alternatively comprise a variety of methods generally known in the art, including hoop and loop fasteners, snaps, buttons, ties, adhesive, and so forth.

In fulfilling attachment of each of the proximal straps 94, 96 respectively to the upper and lower arm cradles, the first end 94*a*, 96*a* is fixedly attached to the buckle whereas the second end 94*b*, 96*b* is fed in succession through a pair of dual elongate apertures 104, 106 extending through the upper members 22, 24 respectively associated with the upper and lower arm cradles, particularly as shown in FIGS. 1 and 6. A sectional bridge 108, 110 separating the dual elongate apertures respectively present in the upper and lower arm cradles accommodates placement of and secures a looped portion 94*c*, 96*c* of the proximal strap 94, 96 as the strap is woven up and down through the dual elongate apertures. The second end of the proximal strap is loop fed thorough the buckle 102 and adjusted accordingly to fulfill the size and fitment requirements for comfortable wear relatively about the golfer's leading arm 20. Similarly, in fulfilling attachment of each of the distal straps 98, 100 respectively to the upper and lower arm cradles 12, 14, the first end 98*a*, 100*a* is fixedly attached to the buckle whereas the second end 98*b*, 100*b* is fed in succession through a pair of elongate apertures 112, 114 extending through the curvilinear portions 58, 60 respectively associated with the upper and lower arm cradles and ultimately loop fed through the buckle and adjusted accordingly for comfortable wear relatively about the golfer's leading arm 20.

Now by way of briefly describing the assembly and operation of the golf swing training aid 10, one may appreciably gain further insight into the relatedness and interaction of the operative components discussed thus far that principally fulfill the utilitarian objects of the present invention.

The upper and lower arms cradles 12, 14 are hingedly connected for pivotal rotation with respect to one another by way of the pass-through bolt assembly 36, 38, which is shown in FIG. 6 as comprising a screw with a threaded receiver 36*a*, 38*a* suited for slidable placement within the first and second sets of aligned apertures 32, 34 formed by the mating flanges 12*b*, 14*b*. A screw with a threaded portion 36*b*, 38*b* is threadably engaged with the threaded receiver and tightened to complete the hinging assembly 16. In completing full assembly of the golf swing training aid 10, the moveable shaft 74 is slidably placed within the internal bore 72 of the second housing section 68 followed by the handle 90 being placed to pass through the elongate opening 88 and threadably engage the threaded bore 74*b*, whereas the proximal and distal straps are respectively fed through the pairs of dual elongate apertures 104, 106 and pairs of elongate apertures 112, 114 with their respective first and second ends meeting at and connecting to the buckle 102 to form an open looped structure 116 to accommodate passage of and circumferentially encompass the golfer's leading arm 20.

After completing the sequence of mechanical assembly, the golfer's leading arm is slidably positioned within the open looped structure 116 or within a double lapping strap configuration 118 as shown in FIG. 5 followed by the upper and lower arm cradles 12, 14 being respectively positioned in vicinity of the triceps 20*a* and forearm area 20*b* with the hinging assembly 16 being located in vicinity of and straddling the elbow joint to the likes shown in FIG. 2, particularly in such position to allow the hinging assembly to pivotally operate in unison or coincide with the bending movement of the golfer's leading arm that generally occurs during the follow-through phase of the golf swing. Once the upper and lower arm cradles are properly located in this manner, the proximal straps 94, 96 and distal straps 98, 100 are adjusted accordingly for fit and feel with the second ends of the straps being pulled from the buckle 102 to tighten the straps comfortably about the golfer's leading arm.

At setup for a golf swing, the locking assembly 18 is initially activated in an engaged, locking state where the upper and lower arm cradles are positioned and maintained in a collinear arrangement. In this regard, the moveable shaft 74 is slidably repositioned within the internal bores 70, 72 of the first and second housing sections 66, 68, primarily in the direction of B in FIG. 11, by grasping and moving the handle 90 until it is located in proximity of the proximal end 88*b* of the elongate opening, whereas such the first magnet 80 of the upper arm cradle is capable of magnetically interacting with the second end 74*c* of the moveable shaft for temporary retention thereat. At this moment, the moveable shaft 74 will occupy the internal bore 70 of the first housing section 66 in its entirely and in part the internal bore 72 of the second housing section, where in particular the moveable shaft will bridge the proximal ends 66*a*, 68*a* of the first and second housing sections.

During the takeaway, backswing and downswing phases of the golf swing, linearity of the golfer's leading arm 20 will be maintained with that of the golf swing training aid 10 by way of the continued retention of the moveable shaft 74 at its initial setup position. On the downswing phase of the golf swing, but momentarily after the golf club's impact with the golf ball, the created jarring and centrifugal forces occurring at this moment will cause the second end 74*c* of the moveable shaft to breakaway or disengage from the first magnet 80 of the upper arm cradle and slide within the aligned arrangement of the internal bores of the first and second housing sections 66, 68 in the direction of B' in FIG. 11 until the first end 74*a* of the moveable shaft abuts against the closed internal end 72*b* and magnetically interacts with the second magnet 82 of the lower arm cradle 14. At this moment, the moveable shaft will reside entirely within the internal bore 72 of the second housing section 68, particularly as such to allow angular displacement of the lower arm cradle 14 from the upper arm cradle 12 along path A in FIG. 7 that primarily coincides with the bending movement of the golfer's leading arm 20 generally occurring during the follow-through phase of the golf swing. Because of the sliding movement of the moveable shaft 74 within the internal bores of the first and second housing sections 66, 68 and the resultant collision of the moveable shaft's first and second ends respectively with the second and first magnets 82, 80 that can produce unsettling noise at times, the closed internal ends of the internal bores may be fitted with a sound dampening member 120 fabricated from rubber, silicone, felt, or an equivalent type of material capable of appreciably diminishing unwanted sounds.

It is obvious that the components comprising the golf swing training aid 10 may be fabricated from a variety of materials, providing such selection or use of materials possess the capacity to withstand forces acting thereon throughout its duration of use in a sport setting or environment.

Figure 13:
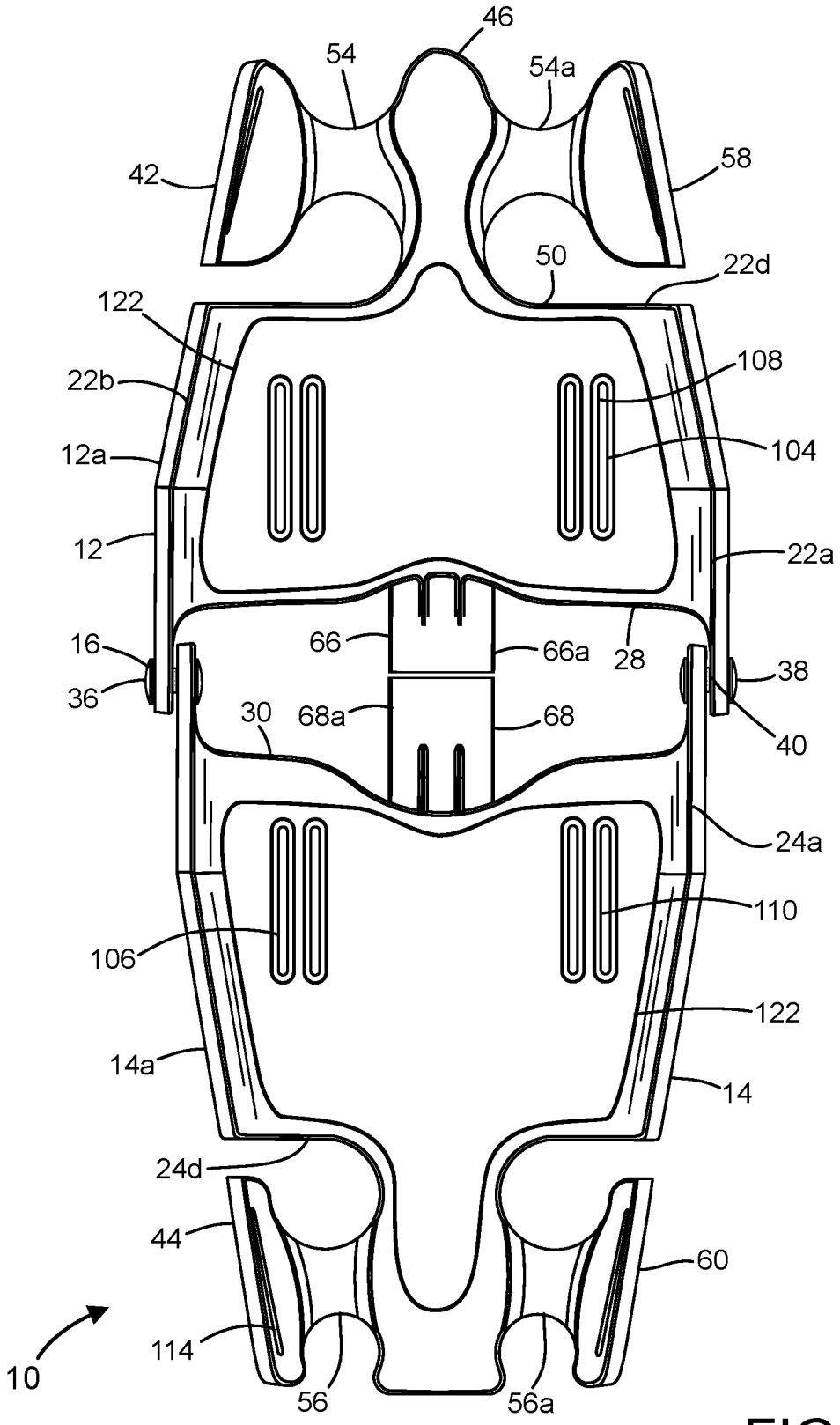
FIG. 13 is a bottom plan view of the preferred embodiment of the present invention illustrating upper and lower arm cradles each having an upper member transitioning to a pair of longitudinal sidewalls, a flange extending outwardly from each of the longitudinal sidewalls forming in part a hinging assembly, a bridging member extending outwardly from each of the upper members and integrally connecting to a pair of opposing protuberances, and a padded lining affixed to an underside surface of each of the upper members of the upper and lower arm cradles.

Accordingly, it is most desirable, and therefore preferred, to construct the upper and lower arm cradles 12, 14 from plastic, aluminum or an equivalent type of material that meaningfully offers reasonable structural strength for its weight, while limiting the extent by which the components may unacceptably fail due to applied forces. In other aspects of fabrication, the moveable shaft 74 is made from carbon steel or equivalent to fulfill magnetic interaction with the first and second magnets 80, 82. It is further contemplated within the scope of fabricating the golf swing training aid 10 that the proximal and distal straps are made from a woven cotton or nylon material or yet in other applications, an elastic material possessing stretching capabilities that fulfills to supplement comfort while the golf swing training aid is securely attached to the golfer's leading arm 20. In furthering aspects of comfortability of the golf swing training aid 10, underside surfaces 22*d*, 24*d* of the upper members 22, 24 respectively associated with the upper and lower arm cradles 12, 14 may receive a padded lining 122 possessing cushioning and compressive qualities such as elastomeric foam, silicone, neoprene, gel-filled pads, and the like, particularly as illustrated in FIG. 13.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention. For instance, the size, material, and placement of the proximal and distal straps connectively associated with the golf swing training aid 10 may differ to fulfill certain requirements. Further, the size, shape, location, and the materials of the upper and lower arm cradles 12, 14, the hinge assembly 16, and the moveable shaft 74 may equally vary. Thus, the scope of the invention should be determined by the appended claims and their legal equivalents rather than by the examples set forth herein.

What is claimed is:

1. A golf swing training aid adaptable for attachment to a golfer's leading arm having an elbow joint, said golf swing training aid comprising, in combination:

an upper arm cradle adaptable for attachment to the golfer's leading arm above the elbow joint and having a first end;

a lower arm cradle adaptable for attachment to the golfer's leading arm below the elbow joint and having a first end;

a hinging assembly for pivotally connecting said upper arm cradle to said lower arm cradle and being adaptably located in vicinity of the elbow joint of the golfer's leading arm; and a locking assembly having a moveable shaft, a first housing section mounted to said upper arm cradle and a second housing section mounted to said lower arm cradle, said first and second housing sections each having an internal bore for housing therewithin said moveable shaft and a proximal end respectively extending openly beyond said first ends of the upper and lower arm cradles.

2. The golf swing training aid as set forth in claim 1, wherein each of said upper and lower arm cradles comprises an upper member integrally connecting and curvilinearly transitioning to a pair of longitudinal sidewalls.

3. The golf swing training aid as set forth in claim 2, wherein said hinging assembly comprises a flange integrally connecting to and extending linearly outward from each of said longitudinal sidewalls of the upper and lower arm cradles.

4. The golf swing training aid as set forth in claim 3, wherein each of said flanges of the upper and lower arm cradles comprises an aperture extending therethrough, said flanges of the upper arm cradle being positioned to engage and mate with said flanges of the lower arm cradle to form a first set of aligned apertures and a second set of aligned apertures with each accommodating passage of a pass-through bolt assembly.

5. The golf swing training aid as set forth in claim 2, wherein each of said upper members of the upper and lower arm cradles comprises a widened portion transitioning to a tapered portion.

6. The golf swing training aid as set forth in claim 2, wherein each of said upper and lower arm cradles comprises a bridging member integrally connecting to and extending outwardly from said upper member respectively associated therewith.

7. The golf swing training aid as set forth in claim 6, wherein each of said upper and lower arm cradles comprises a pair of opposing protuberances integrally connecting to and extending outwardly from said bridging member respectively associated therewith.

8. The golf swing training aid as set forth in claim 7, wherein each of said opposing protuberances comprises a spanning element integrally connecting to a curvilinear portion.

9. The golf swing training aid as set forth in claim 8, wherein said curvilinear portion comprises an elongate aperture to establish a pair of elongate apertures respectively associated with said upper and lower arm cradles for passing therethrough and accommodating a distal strap for circumferentially engaging the golfer's leading arm, said distal strap having a first end connecting to a second end by connective means.

10. The golf swing training aid as set forth in claim 2, wherein each of said upper members of the upper and lower arm cradles comprises a pair of dual elongate apertures for passing therethrough and accommodating a proximal strap for circumferentially engaging the golfer's leading arm, said proximal strap having a first end connecting to a second end by connective means.

11. The golf swing training aid as set forth in claim 1, wherein each of said internal bores of the first and second housing sections comprises an open end and a closed internal end.

12. The golf swing training aid as set forth in claim 1, wherein each of said first and second housing sections respectively comprises a first magnet and a second magnet.

13. The golf swing training aid as set forth in claim 12, wherein said second housing section of the lower arm cradle comprises an elongate opening in open communication with said internal bore associated therewith.

14. The golf swing training aid as set forth in claim 13, wherein said moveable shaft comprises an upright handle extending outwardly therefrom and passing through said elongate opening of the lower arm cradle for manually manipulating said moveable shaft relatively within said internal bores of the first and second housing sections.

15. The golf swing training aid as set forth in claim 12, wherein said moveable shaft comprises a first end capable of magnetically interacting with said second magnet of the second housing section to allow said upper arm cradle to pivot relatively about said hinging assembly and displace angularly from said lower arm cradle.

16. The golf swing training aid as set forth in claim 15, wherein said moveable shaft comprises a second end capable of magnetically interacting with said first magnet of the first housing section to lockingly engage said upper and lower arm cradles in a collinear arrangement.

17. The golf swing training aid as set forth in claim 16, wherein said moveable shaft comprises an effective length to the extent it retracts and resides entirely within said internal bore of the second housing section while said first end of the moveable shaft magnetically interacts with said second magnet and traverses said open ends of the internal bores of the first and second housing sections while said second end of the moveable shaft magnetically interacts with said first magnet.

18. The golf swing training aid as set forth in claim 1, wherein each of said internal bores of the first and second housing sections comprises a cylindrical configuration for accommodating said moveable shaft having an equivalent geometric configuration.

19. A golf swing training aid adaptable for attachment to a golfer's leading arm having an elbow joint, said golf swing training aid comprising, in combination:

an upper arm cradle having an upper member integrally connecting and curvilinearly transitioning to a pair of longitudinal sidewalls, said upper arm cradle being adaptable for attachment to the golfer's leading arm above the elbow joint;

a lower arm cradle having an upper member integrally connecting and curvilinearly transitioning to a pair of longitudinal sidewalls, said lower arm cradle being adaptable for attachment to the golfer's leading arm below the elbow joint;

a hinging assembly for pivotally connecting said upper arm cradle to said lower arm cradle and being adaptably located in vicinity of the elbow joint of the golfer's leading arm; and a locking assembly having a moveable shaft, a first housing section mounted to said upper arm cradle and a second housing section mounted to said lower arm cradle, said first and second housing sections each having an internal bore for housing therewithin said moveable shaft and respectively having a first magnet and a second magnet.

20. The golf swing training aid as set forth in claim 19, wherein each of said upper and lower arm cradles comprises a bridging member integrally connecting to and extending outwardly from said upper member respectively associated therewith and a pair of opposing protuberances integrally connecting to and extending outwardly from said bridging member respectively associated therewith, each of said opposing protuberances having a spanning element integrally connecting to a curvilinear portion.

21. The golf swing training aid as set forth in claim 20, wherein said curvilinear portion comprises an elongate aperture to establish a pair of elongate apertures respectively associated with the upper and lower arm cradles, each of said upper members of the upper and lower arm cradles comprises a pair of dual elongate apertures.

22. The golf swing training aid as set forth in claim 21, further comprising a strap assembly having a pair of distal straps correspondingly passing through said pairs of elongate apertures of the upper and lower arm cradles and a pair of proximal straps correspondingly passing through said pairs of dual elongate apertures of the upper and lower arm cradles.

23. The golf swing training aid as set forth in claim 19, wherein each of said first and second housing sections respectively comprises a first open cavity configured with said first magnet and a second open cavity configured with said second magnet.

24. The golf swing training aid as set forth in claim 19, wherein said moveable shaft comprises a first end capable of magnetically interacting with said second magnet of the second housing section to allow said upper arm cradle to pivot relatively about said hinging assembly and displace angularly from said lower arm cradle and a second end capable of magnetically interacting with said first magnet of the first housing section to lockingly engage said upper and lower arm cradles in a collinear arrangement.

25. The golf swing training aid as set forth in claim 19, wherein said hinging assembly comprises a flange integrally connecting to and extending linearly outward from each of said longitudinal sidewalls of the upper and lower arm cradles, each of said flanges of the upper and lower arm cradles comprises an aperture extending therethrough, said flanges of the upper arm cradle being positioned to engage and mate with said flanges of the lower arm cradle to form a first set of aligned apertures and a second set of aligned apertures with each accommodating passage of a pass-through bolt assembly.

26. The golf swing training aid as set forth in claim 19, wherein said second housing section of the lower arm cradle comprises an elongate opening in open communication with said internal bore associated therewith, said moveable shaft having an upright handle extending outwardly therefrom and passing through said elongate opening of the lower arm cradle for manually manipulating said moveable shaft relatively within said internal bores of the first and second housing sections.

27. A golf swing training aid adaptable for attachment to a golfer's leading arm having an elbow joint, said golf swing training aid comprising, in combination:

an upper arm cradle having an upper member integrally connecting and curvilinearly transitioning to a pair of longitudinal sidewalls, said upper arm cradle being adaptable for attachment to the golfer's leading arm above the elbow joint;

a lower arm cradle having an upper member integrally connecting and curvilinearly transitioning to a pair of longitudinal sidewalls, said lower arm cradle being adaptable for attachment to the golfer's leading arm below the elbow joint;

a hinging assembly for pivotally connecting said upper arm cradle to said lower arm cradle and being adaptably located in vicinity of the elbow joint of the golfer's leading arm, said hinging assembly having a flange integrally connecting to and extending linearly outward from each of said longitudinal sidewalls of the upper and lower arm cradles, each of said flanges of the upper and lower arm cradles having an aperture extending therethrough, said flanges of the upper arm cradle being positioned to engage and mate with said flanges of the lower arm cradle to form a first set of aligned apertures and a second set of aligned apertures with each accommodating passage of a pass-through bolt assembly; and a locking assembly having a first housing section mounted to said upper arm cradle and a second housing section mounted to said lower arm cradle, each of said first and second housing sections having an internal bore for housing therewithin a moveable shaft and respectively having a first magnet and a second magnet, said second housing section having an elongate opening in open communication with said internal bore associated therewith, said moveable shaft having an upright handle extending outwardly therefrom and passing through said elongate opening of the second housing section.

28. The golf swing training aid as set forth in claim 27, wherein said moveable shaft comprises a first end capable of magnetically interacting with said second magnet of the second housing section to allow said upper arm cradle to pivot relatively about said hinging assembly and displace angularly from said lower arm cradle and a second end capable of magnetically interacting with said first magnet of the first housing section to lockingly engage said upper and lower arm cradles in a collinear arrangement.

29. The golf swing training aid as set forth in claim 27, wherein each of said upper and lower arm cradles comprises a bridging member integrally connecting to and extending outwardly from said upper member respectively associated therewith and a pair of opposing protuberances integrally connecting to and extending outwardly from said bridging member respectively associated therewith, each of said opposing protuberances having a spanning element integrally connecting to a curvilinear portion, each of said curvilinear portions having an elongate aperture to establish a pair of elongate apertures respectively associated with the upper and lower arm cradles, each of said upper members of the upper and lower arm cradles having a pair of dual elongate apertures.

30. The golf swing training aid as set forth in claim 29, further comprising a strap assembly having a pair of distal straps correspondingly passing through said pairs of elongate apertures of the upper and lower arm cradles and a pair of proximal straps correspondingly passing through said pairs of dual elongate apertures of the upper and lower arm cradles, each of said proximal and distal straps having a first end connecting to a second end by a buckle.

* * * * *